US005372075A

United States Patent [19]

Graf

[11] Patent Number: 5,372,075

[45] Date of Patent: Dec. 13, 1994

[54] DISMOUNTABLE DISPLAY CASE

[76] Inventor: Rudolf Graf, Reichenbachstr. 16, D-8000 München 5, Germany

[21] Appl. No.: 924,051

[22] PCT Filed: Mar. 5, 1991

[86] PCT No.: PCT/DE91/00195

§ 371 Date: Sep. 4, 1992

§ 102(e) Date: Sep. 4, 1992

[87] PCT Pub. No.: WO91/13577

PCT Pub. Date: Sep. 19, 1991

[30] Foreign Application Priority Data

Mar. 5, 1990 [DE] Germany ..... 4006874

[51] Int. Cl.[5] ..... A47B 3/00

[52] U.S. Cl. ..... 108/180; 312/128; 108/153

[58] Field of Search ..... 108/111, 153; 312/249.8, 122, 128

[56] References Cited

U.S. PATENT DOCUMENTS

| | | | |
|---|---|---|---|
| 2,628,877 | 2/1953 | Woo | 312/128 |
| 3,203,374 | 8/1965 | Gingher et al. | 108/153 |
| 3,584,927 | 6/1971 | Oh | 312/128 |
| 3,756,168 | 9/1973 | Bushhead | 108/153 |
| 3,905,662 | 9/1975 | Richmond | 312/249.8 |
| 4,572,593 | 2/1986 | Takamizawa et al. . | |
| 4,611,866 | 9/1986 | Everett | 312/249.8 |

FOREIGN PATENT DOCUMENTS

| | | |
|---|---|---|
| 1483897 | 6/1967 | France . |
| 8503540 | 7/1987 | Netherlands . |

*Primary Examiner*—Michael J. Milano
*Attorney, Agent, or Firm*—Kenyon & Kenyon

[57] ABSTRACT

A dismountable display cabinet comprises a box-shaped container, consisting of a base part 4 and a lid part 6. A dismountable framework can be mounted on the base part 4, the framework including posts 12 to 22 which have guide grooves for receiving side wall elements and shelf elements in the form of glass panes in a displaceable manner. The lid part 6 of the container forms the top closure of the display cabinet. In the dismantled state of the display cabinet the individual parts of the framework, the shelves and the side walls are stowed inside the container. In the dismantled state the display cabinet can be easily transported, requires litle space and can be assembled and dismantled very rapidly and simply.

22 Claims, 4 Drawing Sheets

DISMOUNTABLE DISPLAY CASE

The invention concerns a dismountable display cabinet for objets d'art, jewellery or the like, with at least two superposed horizontal shelves and with vertical side walls.

BACKGROUND OF THE INVENTION

Such dismountable display cabinets are used, for example, by antique dealers or jewellers for the purpose of exhibiting their wares at fairs, exhibitions or the like and, consequently, they should be able to be assembled and dismantled rapidly and simply, require little space and be transportable in the dismantled state. A conventional display cabinet system comprises loose glass panes which can be connected with each other by means of suitable corner connectors made of metal. The corner connectors have grooves, into which the glass panes can be pushed; to ensure an adequately secure connection between the glass panes and corner connectors, the inside of the grooves of the corner connectors are provided with frictional materials, so that the assembly of the corner connectors and glass panes or the detachment of the glass panes from the corner connectors requires a large force; due to the relatively large holding forces of the corner connections, the glass panes must be knocked and/or pressed into the grooves of the corner connectors. This makes the assembly and dismantling of the known display cabinets cumbersome and time consuming. There is also the substantial danger that the glass panes of the known display cabinets will break during assembly and dismantling.

On the other hand, display cabinets are known which are constructed as solid furniture pieces. These display cabinets are also widely used, but have the considerable disadvantage that they do not fit into normal cars or vans and therefore an additional trailer needs to be used to transport such display cabinets.

BRIEF SUMMARY OF THE INVENTION

Consequently, the primary object of the invention is to provide a dismountable display cabinet of the type mentioned in the introduction, which can be assembled and dismantled in a simple manner and rapidly without needing a large force and which is easily transported. Furthermore, the cabinet occupies little space in the dismantled state.

This object is essentially achieved by a box-shaped container which is divided in a horizontal plane into two and has a base part and a lid part, several vertical posts which can be detachably mounted to the base part in their vertical position when the container is open and which in their fixed position form a framework for the shelves and the side walls, and the posts include vertical and horizontal guide grooves, wherein the shelves and the side walls are received in a slideable manner in the oppositely situated guide grooves of adjacent posts and wherein the dimensions of the individual parts of the framework, of the shelves and of the side walls are at most the same as the internal dimensions of the container, so that the individual parts can be accomodated in the inside of the container when the display cabinet is in the dismantled state.

Thus the display cabinet system according to the invention in the dismantled state is a box-like container, in the inside of which the individual parts necessary for the display cabinet are accomodated. For the purpose of assembly the box-like container is opened by lifting the lid part, and at the same time the base part of the container forms the base part of the display cabinet. Following this the vertical posts are fixed in the base part in a suitable manner, resulting in a framework for the shelves and the side walls. Afterwards the side walls and the shelves are pushed into the guide grooves, level by level, without the necessity of exerting considerable force. Following this, in accordance with a preferred development of the invention, the lid part can be placed onto the framework, so that the framework may obtain additional stability and the lid part is neat.

The framework may comprise an upper horizontal stabilising frame, which can be placed onto the posts after fixing the vertical posts on the base part and can be fixed to the posts in a suitable manner; a great number of suitable fittings are known to the person skilled in the art, for example from the furniture industry. The upper stabilising frame should be constructed so that it would not hinder an insertion of the side walls from above into the guide grooves of the vertical posts.

The stabilising frame preferably consists of individual frame parts which can be detachably connected with each other and with the posts by means of suitable fittings in the form of rods, which in the dismantled state can be accomodated in a small space inside of the box-shaped container.

To fasten the posts to the base part, stabilising sleeves may be provided, which are mounted to the base part and into which the posts can be inserted. Also, the posts could be constructed so that they could be screwed into the base part.

Also it could be useful if sleeves or the like are provided in the lid part of the container, with which the posts engage with their top ends when the lid is placed on; in such a case a stabilising frame would become unnecessary.

As a rule, a display cabinet should be accessible from one side even after it has been assembled, however, this accessible side should be constructed so that it could be locked, so that at least at times the display cabinet could be left unattended. For this purpose, in accordance with a preferred development of the invention, one side of the display cabinet can be locked by means of sliding doors, these sliding doors being dimensioned so that they do not exceed the internal dimensions of the box-like container. The grooves and the like which are provided for the sliding doors may be constructed in top and bottom guide strips, which are or may be fixed either on the framework or on the lid part and the base part.

According to a particularly preferred embodiment of the invention an illuminating device is installed in the lid part of the box-shaped container, which, for example, may be connected to the mains by a connector, provided on the outside of the lid part.

In a further preferred construction of the invention rollers are provided on the underside of the base part, which can be detachably mounted on the base part in the manner of conventional furniture castors and which then may be removed or inserted depending on the requirements.

In addition, or alternatively, it may be further proposed that the base part is carried by wheels, which, for example, can be detachably mounted on the base part, especially by means of insertable pivots, or which are fastened, detachably if desired, on a frame on which the base part rests. These wheels are provided primarily for the transport of the dismantled display cabinet to and from a display area, and, accordingly, should have sufficiently large dimensions sufficiently large to ride over large irregularities, such as doorway thresholds and the like.

BRIEF DESCRIPTION OF THE DRAWINGS

Further advantageous features of the invention will become apparent from the following description refering to the drawing in which several embodiments are illustrated in detail. In the drawing the following are illustrated schematically and semischematically.

DETAILED DESCRIPTION

Figure 1:
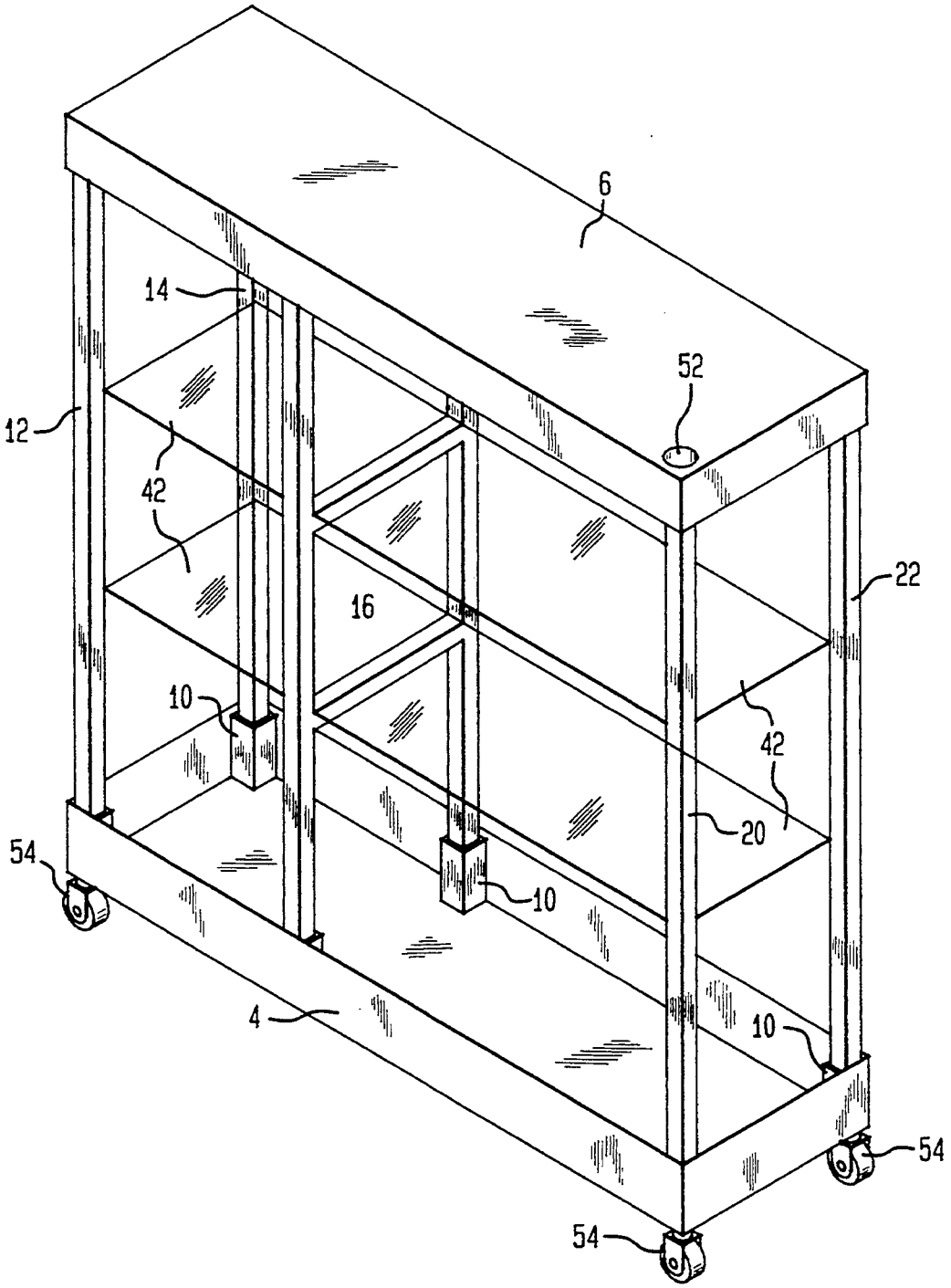
FIG. 1—perspective illustration of the display cabinet according to the invention in the assembled state, FIG. 2—the upper region of the display cabinet according to FIG. 1 with the lid part removed, FIG. 3—an inside view of the lid part, FIG. 4—horizontal sectional view through the display cabinet towards the base part from above, FIG. 5—a detail of one of the posts of the display cabinet in accordance with FIG. 1, FIG. 6—a horizontal section through the post according to FIG. 5, and along the plane VI—VI, FIG. 7—the display cabinet according to FIG. 1 in the dismantled state and stowed in the box-shaped container, and FIG. 8—a wheel frame for a dismantled display cabinet which is stowed in the box-shaped container.

The display cabinet according to FIGS. 1 to 7 comprises a box-like container 2, which is made up of a lower base part 4 and an upper lid part 6. In the closed state of the container 2, illustrated in FIG. 7, the lid part 6 is secured to the base part 4 by means of suitable fittings 8.

Inside the base part 4, at the edges, several tubular sockets are mounted, into which the vertical posts 12, 14, 16, 18, 20 and 22 can be inserted. The length of each of the posts 12 to 22 is at most equal the length of the inside space of the container 2.

Figure 2:
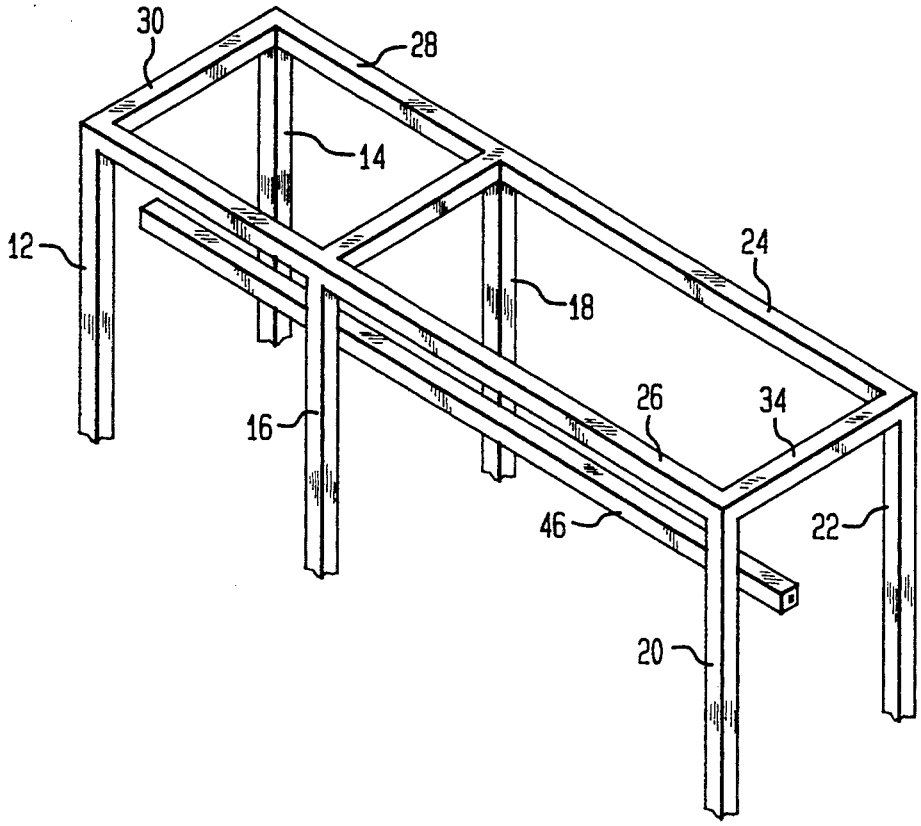

As can be seen from FIG. 2, a stabilising frame 24 is placed onto and fixed to the upper ends of the posts 12 to 22, the stabilising frame comprising longitudinal frame parts 26 and 28 and transverse frame parts 30, 32 and 34.

Figure 5:
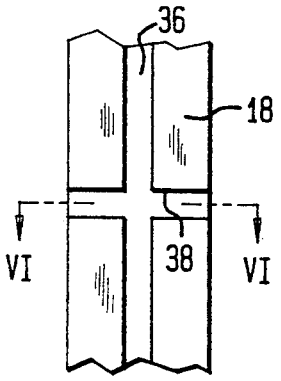
Figure 6:
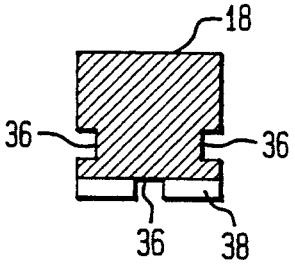
Figure 7:
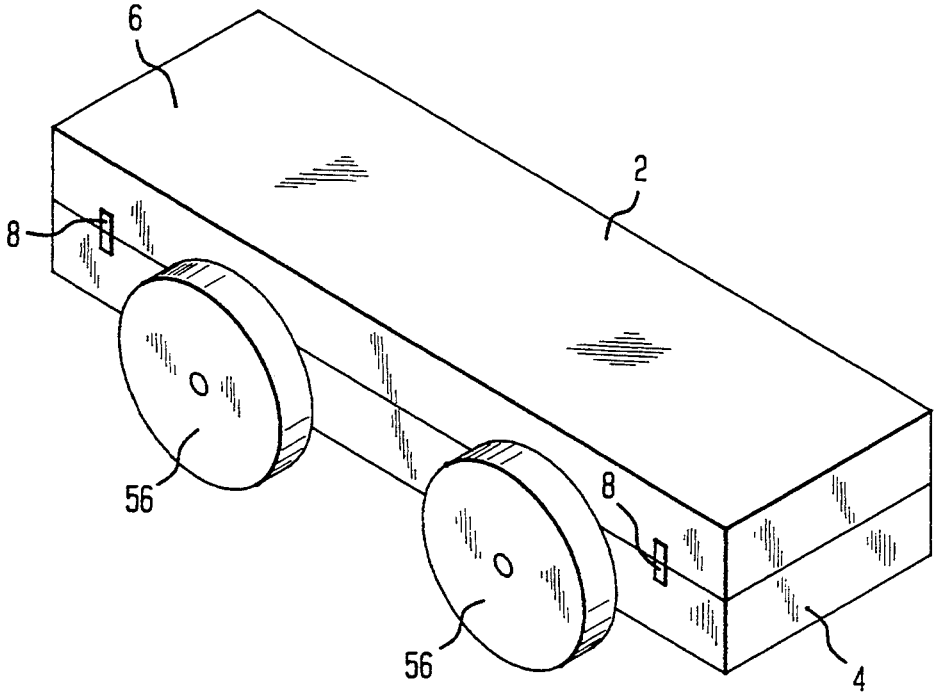
Figure 8:
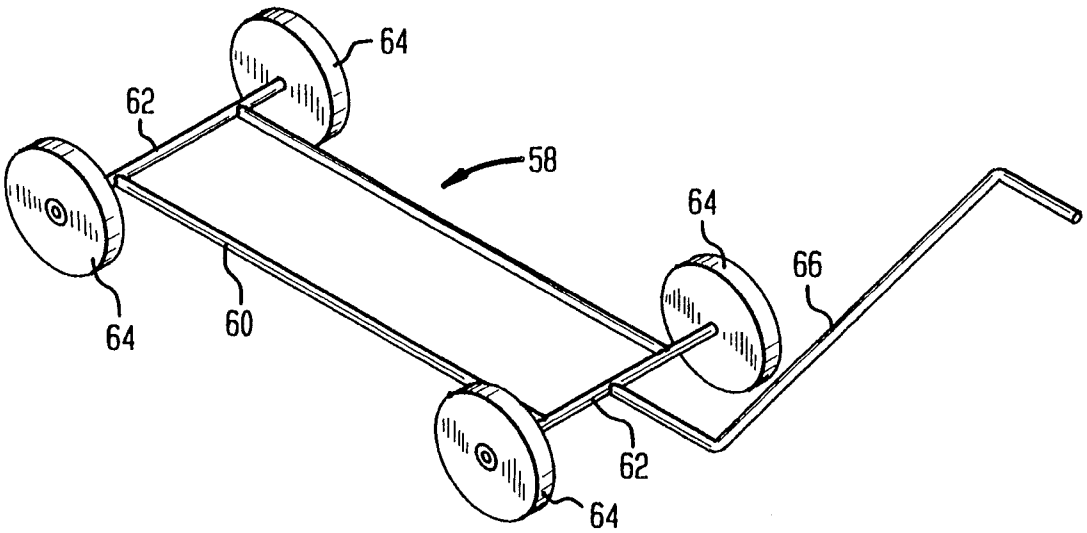

The wall of the display cabinet which is at the rear in the illustration shown in FIG. 1 as well as the two sides of the display cabinet which meet it at right angles are sealed by means of transparent side wall elements 40 (not illustrated) made of glass or plexiglas; the intermediate shelves of the display cabinet are also formed from transparent shelf elements 42, made of glass or plexiglas. For the purpose of holding the side wall elements and the shelf elements, suitable grooves are provided in the posts 12 to 22, so that the side wall elements and the shelf elements, respectively, are held and located in the grooves of oppositely situated posts. FIGS. 5 and 6 show the guide grooves on the case of the post 18. Thus vertical guide grooves 36 are formed in the posts for the side or intermediate wall elements and horizontal grooves 38 are formed for the shelf elements. The vertical guide grooves 36 are accessible from above, so that the side and intermediate wall elements can be inserted into the framework from above. The horizontal grooves are also made continuous and thus can be accessed from the outside, so that the shelf elements can be slid into the framework from the side.

The wall of the display cabinet closer to the observer in the illustration of FIG. 1 can be closed by means of sliding doors 44, which are offset in a known manner, to enable sliding of the doors relative to each other. To guide the sliding doors at the top and bottom, top and bottom guide strips 46 and 48, respectively, are provided, while the guide strips 46, 48 are or may be fixed either on the framework or on the lid part 6 and on the base part 4 of the container 2. Each of the two guide strips 46, 48 have two parallel guide grooves (not illustrated) extending in the longitudinal direction, for guiding the sliding doors 44.

The dimensions of the individual side wall elements 40, of the shelf elements 42 and of the sliding doors 44 are such that they can be easily accomodated in the inside of the container 2.

Figure 3:
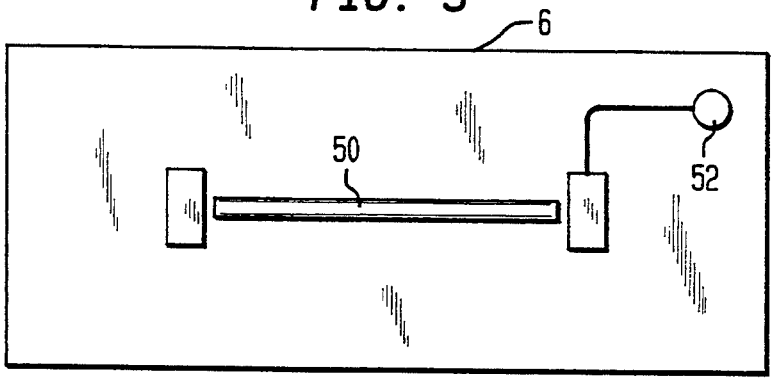
Figure 4:
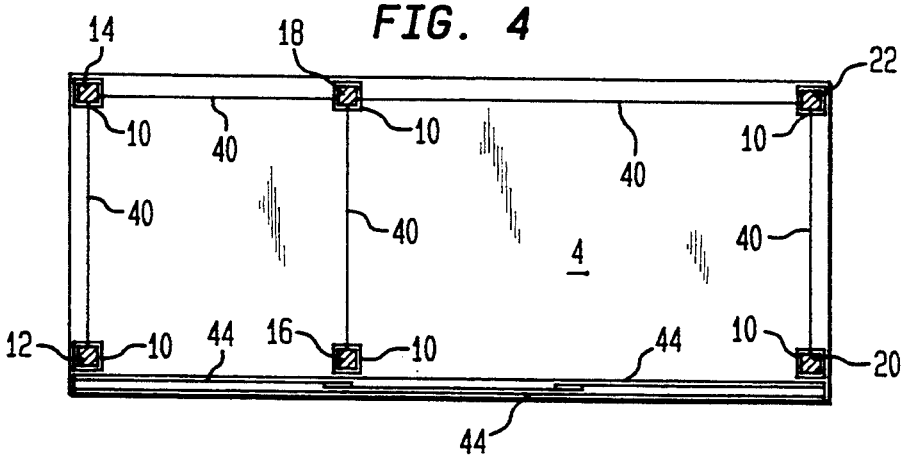

As can be seen from FIG. 3, an illuminating device 50 is installed on the inside of the lid part 6, which, if necessary, can be connected to the mains by a connector 52, accessible from the outside.

On the underside of the base part 4 furniture castors 54 are provided, which can be inserted into guide sleeves (not illustrated) on the underside in a known manner, by means of rotating mountings and, if desired, enabling insertion or removal.

To dismantle the display cabinet from the working position illustrated in FIG. 1, the lid part 6 is removed, the side wall elements 40 and the shelf elements 42, as well as the sliding doors 44 are pulled out of their guide grooves, the framework is dismantled into its single parts and detached from the base part 4, and subsequently the posts, parts of the frame and the glass panes are stowed inside of the container 2 and the container is closed by placing the lid part 6 onto the base part 4. For the purpose of transporting the closed container 2, instead of the furniture castors 54 it may be desirable to provide larger wheels 56, which are mounted to the base part 4 of the container 2 by means of insertable stub shafts (not illustrated) and which, if desired, can be removed.

As an alternative, a wheel frame is provided which is designated in toto by the reference numeral 58, which wheel frame comprises a frame 60 with axles 62 and wheels 64 mounted thereon. The container 2 can be placed onto this frame 60 and, if required, fastened on it by means of suitable locking or securing means. A handle which can also be removed, if desired, from the frame 60, enables the wheel frame 58 to be easily moved forward with the container 2 located on it.

The invention is not limited to the embodiments described. For example, it could be of advantage to use a roller shutter instead of the sliding doors 44, which roller shutter may be mounted on the lid part 6, guided laterally by the posts 12 and 20 and locked to the base part 4.

The subject matter of the invention can be also used as a wall-mounted shelf or the like instead of a display cabinet, in which case the basic principles of the design are the same and the side wall elements and/or the shelf elements at least partially may be made of timber, plywood or their substitutes.

What is claimed is:

1. A dismountable display cabinet, having an assembled state and a dismantled state, comprising:

at least two superposed horizontal shelves;

vertical side walls;

a box-shaped container having internal dimensions and being divided, along a horizontal plane, into a base part and a lid part; and several vertical posts which when in said assembled state are detachably mounted to the base part in their upright position when the container is open, which when mounted in position form a framework for the shelves and the side walls, and which include vertical and horizontal guide grooves whereby the posts receive the shelves and the side walls in a slideable manner in oppositely situated guide grooves of adjacent posts, wherein the shelves, the side walls, and the posts are dimensioned to be, at most, the same as the internal dimensions of the container, so that the container accommodates the shelves, the side walls and the posts when in said dismantled state.

2. The display cabinet according to claim 1, wherein the lid part is arranged on the erected framework.

3. The display cabinet according to claim 1, wherein the framework comprises an upper horizontal stabilizing frame which is detachably connected to top ends of the posts.

4. The display cabinet according to claim 3, wherein the stabilizing frame comprises individual frame parts which are detachably connected to each other and to the posts.

5. The display cabinet according to claim 1, wherein an electrical illuminating device for the display cabinet is installed on the inside of the lid part.

6. The display cabinet according to claim 1, wherein rollers are provided on the underside of the base part.

7. The display cabinet according to claim 6, wherein the rollers are detachably mounted in the manner of conventional furniture castors.

8. The display cabinet according to claim 1, wherein the base part is carried by wheels.

9. The display cabinet according to claim 8, wherein the wheels are detachably mounted to the base part, in particular by means of insertable stub shafts.

10. The display cabinet according to claim 8, wherein the wheels are mounted on a frame on which the base part rests.

11. The display cabinet according to claim 1, wherein one side of the display cabinet can be closed by means of sliding doors or by a roller shutter.

12. The display cabinet according to claim 3, wherein the lid part is arranged on the erected framework.

13. The display cabinet according to claim 12, wherein the stabilizing frame comprises individual frame parts which are detachably connected to each other and to the posts.

14. The display cabinet according to claim 2, wherein an electrical illuminating device for the display cabinet is installed on the inside of the lid part.

15. The display cabinet according to claim 3, wherein an electrical illuminating device for the display cabinet is installed on the inside of the lid part.

16. The display cabinet according to claim 4, wherein an electrical illuminating device for the display cabinet is installed on the inside of the lid part.

17. The display cabinet according to claim 12, wherein an electrical illuminating device for the display cabinet is installed on the inside of the lid part.

18. The display cabinet according to claim 13, wherein an electrical illuminating device for the display cabinet is installed on the inside of the lid part.

19. The display cabinet according to claim 5, wherein rollers are provided on the underside of the base part.

20. The display cabinet according to claim 5, wherein one side of the display cabinet includes sliding doors, the sliding doors having an opened state and a closed state.

21. The display cabinet according to claim 5, wherein one side of the display cabinet includes a roller shutter having an opened state and a closed state.

22. A dismountable display cabinet having an assembled state and a dismantled state comprising:

at least two superposed horizontal shelves each having a length dimension and a width dimension;

vertical side walls each having a length dimension and a width dimension;

a base having a bottom surface and four side walls, said four side walls defining an inside length which is greater than the length dimension of each of the at least two shelves and which is greater than the length dimension of each of the vertical side walls and defining a width which is greater than the width dimension of each of the at least two shelves and which is greater than the width dimension of each of the vertical side walls a lid having a top surface and four side walls, said four side walls of said lid defining an inside length which is greater than the length dimension of each of the at least two shelves and which is greater than the length dimension of each of the vertical side walls and defining a width which is greater than the width dimension of each of the at least two shelves and which is greater than the width dimension of each of the vertical side walls; and several vertical posts, each having a top end and a bottom end, wherein said display cabinet is in said assembled state, said bottom end of each of said vertical posts is detachably mounted to the base, and each including vertical and horizontal guide grooves whereby the posts receive the shelves and the side walls in a slideable manner, and wherein when said display case is in a dismantled state said base and lid define a closed container which accommodates each of said several vertical posts, said horizontal shelves, and said vertical side walls.

* * * * *